US006920825B1

(12) United States Patent
Baxter

(10) Patent No.: US 6,920,825 B1
(45) Date of Patent: Jul. 26, 2005

(54) MAGNETIC STAMP PRINTING DEVICE

(76) Inventor: Brent Alan Baxter, 3946 Alemany Blvd., San Francisco, CA (US) 94132-3207

( * ) Notice: Subject to any disclaimer, the term of this patent is extended or adjusted under 35 U.S.C. 154(b) by 0 days.

(21) Appl. No.: 09/465,997

(22) Filed: Dec. 17, 1999

(51) Int. Cl.[7] ..... B41K 1/02; B41K 1/56
(52) U.S. Cl. ..... 101/327; 101/389.1; 101/405
(58) Field of Search ..... 101/327, 333, 101/368, 389.1, 395, 401.1, 405, 406; 434/168; D18/15

(56) References Cited

U.S. PATENT DOCUMENTS

| | | | | | |
|---|---|---|---|---|---|
| 2,620,731 | A | * | 12/1952 | Slonneger | 101/405 |
| 2,994,266 | A | * | 8/1961 | Sparrow | 101/380 |
| 4,366,637 | A | * | 1/1983 | Dechamps | 40/621 |
| 4,854,235 | A | * | 8/1989 | Lyon | 101/389.1 |
| 5,313,885 | A | * | 5/1994 | Winston | 101/405 |
| 6,371,022 | B1 | * | 4/2002 | Crystal | 101/333 |
| 6,422,140 | B1 | * | 7/2002 | Lookholder et al. | 101/129 |

FOREIGN PATENT DOCUMENTS

DE 198 26 762 A1 * 12/1998

* cited by examiner

*Primary Examiner*—Leslie J. Evanisko

(57) ABSTRACT

An improved rubber stamp fastening and printing device consisting of operatively magnetic or veritable magnetic stamp-die components and an outer magnetic connecting mount, utilizing distinct vertical magnets imbedded within a transparent material. Both the stamp-dies and mount are provided with suitable magnetic means with which to maintain a secure, yet easily manipulable magnetic bond; where these components are themselves composed of are either magnet, or ferromagnetic materials. The combination between strong slender vertical magnets or and the viewable negative spaces within the compositional translucent material create a superior transparency through the mount; this ability to directly view the see the magnetically fastened stamp-dies from reverse, allows for a very high degree of control and ability to accurately place these magnetic stamp-dies during the process of stamping. Flexible magnet or ferromagnetic sheeting can be cut by hand into various shapes and attached to the mount in order to function as alternative hand-cut magnet printing stamp-dies. Structural expansion of the stamp mount can result in a sheet storage device for holding a plurality of magnetic stamp member-dies for use in a binder system for example. The permanent magnet stamp mount of this invention, when used alone can function as a highly-translucent permanent magnet which operates in the usual magnet manner, such as a fastening magnetically reactive metal objects. Or the magnetic stamp-dies (or even the mount itself) can function by themselves as decorative and utilitarian magnets. When magnetic elements are imbedded in a non rigid transparent material, the stamp mount can be modified to create a flexible, malleable semi-transparent magnet which is capable of conforming to a high degree to the shape of the form being fastened to.

12 Claims, 8 Drawing Sheets

LENGHTHENED
CONNECTING BASES
THREE PATTERNS

COMPONENT PARTS

FERROMETRIC BASE

COUPLING UNITS AND BASE UNIT

FERROMETRIC BASE

FERROMETRIC BASE

SIDE VIEW OF TWO UNIT MAGNETIC SYSTEM

STAMP MOUNT MODIFIED
FOR STAMP DIE STORAGE

TRANSPARENT MOUNT AND OVERSHEET

THREE PATTERN S OF CONNECTING BASES

STAMP DIES SEEN THROUGH MOUNT

STAMP DIES SEEN
THROUGH PARTICLES

LENGHTHENED
CONNECTING BASES
THREE PATTERNS

OVERHEAD VIEW
OF LENGTHENED
CONNECTING BASES

COUPLING UNIT
WITH CUSHION

CUSHION MOUNT -
MOUNT SIDE UP (y) SIDE VIEW OF MAGNETIC FILAMENTS (z)

FILLAMENTS VIEWED FROM OVERHEAD

COUPLING UNITS USED AS MAGNETIC FASTENERS

MAGNETIC STAMP PRINTING DEVICE

CROSS-REFERENCE TO RELATED APPLICATIONS

Not Applicable

STATEMENT REGARDING FEDERALLY SPONSORED RESEARCH AND DEVELOPMENT

Not Applicable

REFERENCE TO A MICROFICHE APPENDIX

Not Applicable

BACKGROUND OF THE INVENTION

1. Field of the Invention

This invention relates to a magnetic stamp member holding and positioning device which provides a simple, economical and highly flexible means to magnetically manipulate single or multiple stamp member-dies on single stamp mount. Although the invention will find uses in other areas, its principal importance is for use in conjunction with removably, securing, combining and repositioning articles such as rubber stamp member-dies to stamping mounts, and the like, during rubber stamp printing. Both the stamp member-die and the stamp mount unit have appropriate magnetic means of the correct polarity which are aligned so as to provide a operative hold of the above mentioned components of a magnetic rubber stamp. And due to the reciprocal nature of magnets and magnetic alloys, either the mount or the stamp member can have its principal magnetic means employed by magnetic elements whereas it respective partner will either utilize a ferromagnetic metallic substance or another appropriately aligned magnetic element. This flexibility allows the base to serve multiple functions.

2. Description of Related Art

Rubber stamps are enjoyed by a large number consumers, both young and old as a means of creating quick and rewarding reusable images (as well as being used for businesses or industrial stamping applications). Rubber stamps are also highly appreciated by those with strong creative impulses, but may not have much artistic talent. Yet, whatever their application, typical "rubber stamps" are composed of two main elements, an ink receiving raised stamp image—referred to as a "stamp die" 02—and a mounting device, or "mount" 16 on which to house the stamping member—referred to as a stamp mount, and more often referred to in the vernacular as a "handle". An optional thin intermediary cushioning substance 30 is typically sandwiched between the two main portions described above and is typically intended for compression absorption and the springing action which aids in producing clear resultant inked images (not to mention giving that wonderful "cushiony" feel to the hand). No matter what their terminology or usage, rubber stamps generally contain only the three above mentioned components. Also, rubber stamps can be created and purchased with a wide variety of materials. However, those wishing to utilize rubber stamps—from the individual consumer to large scale stamp users—have been restricted to using rubber stamps which only have permanent or non-adjustable images on them. These rubber stamp images, the stamp dies 02, are typically glued to a stamp mount 16, normally of wood, foam or less frequently, clear acrylic and as such are immovable.

For the consumer, the stamp member-die portions of rubber stamps 02 can optionally be purchased as individual pieces, sans mounting hardware 16. Consumers generally buy these unmounted stamp member-dies 02 in order to save money and sometimes as a way of addressing the problem of storage (often a concern with large quantities of rubber stamps). Owners of unmounted stamp member-dies 02 must fasten these unmounted stamp member-die pieces 02 to their own mounts 16, which are either purchased or created. Whatever, the choice for a stamp mount 16, the consumer then needs to fasten said unmounted stamp member-dies using either a conventional permanent adhesive or a temporary removable fastening adhesive. The following analysis concerns the basic advantages and disadvantages to a temporary adhesive fastening of a stamp member-die 02 to a stamp mount 16; of course any discussion regarding single components should also be applicable to multiple joined mount components as well. In addition, the following refers primarily to temporary fastening of an unmounted stamp member-dies 02 to a clear acrylic mount 34, where these strategies are also employed (but most of these same mounting strategies can be used on any stamp mount materials, whether opaque or translucent). For the stamp user, a transparent stamp mount 34 yields the main advantage of enabling said user to peer through his/her stamp mount, thereby allowing the individual to predict almost the exact placement and positioning of the resulting stamped image.

The advantages to a temporary fastening of unmounted stamp member-dies, would be to be able to interchange many unmounted stamp member-dies 02 on a single stamp mount. The preferred method of temporarily fastening these unmounted stamp member-dies is by using a hooked and looped method such as the type with the brand name Velcro, or a sheet of acetate, both commonly used by stamp aficionados.

Both of the above methods provide removability and interchangeability of stamp members as well as maintaining the visibility of the stamp member through its clear fastening mechanism. In the Velcro approach, the stamp member-die is fastened to one part of the Velcro fastener unit and then the other part of the Velcro fastening unit is adhered to a translucent stamp mount 34. In its distinguishing manner, the hooks and loops of the Velcro fastener pieces interlock to provide the temporary and removable fastening of the stamp member-die 02. In the acetate mounting method the adhesion of said stamp member-die to stamp mount is accomplished through a static molecular attraction, a commonly known characteristic of acetate sheeting on slick surfaces. The attraction and molecular bond of the acetate sheet method is strong enough to hold a typical stamp member-die on to a slick glass/acrylic-like, mounting surface. However, there are a number of disadvantages with either of these temporary bonding strategies described above when utilized in rubber stamping.

Some disadvantages when using Velcro on a clear mount includes the following: the image, while being able to be interchanged easily enough, cannot be easily repositioned. A larger surface area of said stamp mount can be covered with its appropriate Velcro fastening component, to allow for repositioning; however, this will also seriously negated the "see-through" benefits of the image beneath it. In addition, over time, portions, or all of any Velcro strip, by the nature of its interlocking hook and loop fastening will tend to wear out or become clogged with impurities and lose its adhesive effectiveness; Velcro also has bits which tend to break off over time (creating Velcro "crumbs" which could hinder stamping).

The second method of temporary fastening and used exclusively with smooth glass-like translucent surfaces (usu. acrylic mounts) includes affixing said stamp member-die with a piece of clear acetate sheeting. However, even this method tends to wear out over time as the acetate sheet begins to wear, bend and crinkle thereby losing much of its molecular bonding properties. Finally in regards to repositioning, while easier to remove and reposition than Velcro, since acetate also rolls, kinks and damages, this method while useful, has a finite life and must be replaced over time. In addition, acetate sheeting has limitations regarding the weight of the stamp mount fastened, being much better with smaller lightweight pieces. While both the Velcro and the acetate on acrylic methods offer a moderate amount of image control concerning replaceability of stamping member-dies on a single limited regarding placement of these stamp member-dies. And of course, the above discussion, while primarily applicable with clear stamp mounts, such as acrylic, or glass, could be utilized with smooth opaque materials, with all the benefits of acrylic mounting, sans the advantages of the stamp mount 34 being "see-through". The examples above, while allowing for image replaceability, are somewhat restricted when it comes to stamp image repositioning and combinability.

One interesting prior art stamping device has been invented which coincidentally utilizes a magnetic means to create stamp images. This invention (Magnetic Stamp Pad Applicator, #4221644, Sept. 09, 1994, by Lester S. Krulwick, New York) employs magnetic materials imbedded in a stamp handle in such a way ) as to repel companion pieces partially forward to create stamping surfaces (utilizing the repulsion properties of appropriately aligned magnetic elements). In addition, this mechanism employs a complexity of holes, thin posts and heads combined to control these magnetically engaged stamp heads being "pushed out". Yet, while the above invention similarly employs magnetic materials within a single stamp creating device, the use of magnetic elements, here, is actually for the opposite purpose of repelling a stamp member head, while my invention, conversely, is intended to make use of the attraction potential of magnetically attracted stamp handle.

BRIEF SUMMARY OF THE INVENTION

Objects and Advantages

An important primary object of my invention therefore is to provide a highly flexible and convenient means of creating magnetically repositionable, moveable, removable, interchangeable, customizable and combinable rubber stamps. In this invention single stamps could be quickly and flexibly manipulated in virtually an infinite variety of ways, several stamps can be combined—to make scenes for instance—or users can stamp all their words at one time; the stamping results of this invention actually seem quite limitless.

Another object of this invention which would be of considerable personal or business value, and may find high applicability in large scale stamping operations, is to provide an efficient mechanism for speeding up the time necessary to produce a finished stamp allowing the user to quickly and functionally recombine or adjust an existing stamp image, or stamp many images on a single stamp at the same time, or single images, may be substituted, remain in use, or be used again and again. This would be of great value, for example in businesses, such as changing an employees name, or a sale item on their existing rubber stamps. Moreover, this invention could be used in assembly-line stamping such as of machinery or parts, where in the past many stamps were needed and with this invention, the same result could be accomplished with a fewer, or a single multi-purpose adjustable stamp, resulting in savings of both cost and time for the manufacturer.

A further highly useful object of this invention is to provide an educational, classroom instructional tool where pre-made letters, words and image stamps could be combined to help teach many subjects such as phonics, reading, story telling, math and science concepts, as well as many other educational pedagogical activities where children using interchangeable easily manipulatable stamp components would be helpful and desirable. In this manner, this invention would find effective usefulness in make the development of education both more fun and approachable to learners of any age and may have specific added applicability to bilingual second language learners, and special needs populations. It can also be used emphasize and teach the process of stamp making, itself.

Additionally, another useful object of this invention would be in clinical settings, where magnetic stamp member-dies could be created with select "story telling" images where individuals having trouble speaking, communicating, or "expressing* themselves" could do so through stamping. I see this specifically being used in counseling centers where frightened children, or troubled youths, could communicate using a less threatening manner of "stamp play". These youngsters may be more inclined to communicate important information during these times when they wouldn't normally do so otherwise. Such youngsters may communicate readily during such a time of "fun and play"; and for most, stamps are synonymous with this.

A further important object of this invention is to provide a means of removably holding, collecting and storing a variety of individual stamp member-dies in a single location (such as on a magnetic sheet) so that they are easily accessed, can be maintained in an orderly fashion (e.g. alphabetically or thematically). This would also making it less likely they will be damaged or misplaced and would be characterized by the ease of removal of the said stamp member dies from their magnetically suspended positions.

Another object of this invention is that the user to readily create their own custom stamp images by simply cutting out the shapes of any image desired out of magnetic rubber material and simply and magnetically fastening these images anywhere to their stamp mount. This would be especially valuable for those wishing to expediently try out new designs and would be directly approachable to young or novice stamp users, where they could create their own images, using words, pre-cut shapes, by hand or by stencil, or any combination of pre-manufactured stamp member dies, and where they can foster pride in themselves and develop self esteem, as well as simply have fun.

An added object of this invention is to provide an alternate use for magnetic stamp images to dually function as decorative magnets and likewise function as holding devices of papers and the like on magnetic surfaces when said materials (such as papers and the like) are sandwiched between the these stamp member-dies and a ferromagnetic metal surface. In other words, they can function as "refrigerator magnets".

Another object of this invention is to allow the users conveniently modify existing clear mount rubber stamp component parts (such as unmounted stamp member-dies 02 with clear acrylic stamp mounts) by utilizing a clear oversheet 32) to make them become—in effect—magnetic. In this way, the clear stamp mount user can save money—by not having to purchase separate mounts for each stamp die—reduce needed storage space and allows recycling of existing stamp images into "magnetic stamps". This invention readily makes use of pre-manufactured stamping supplies (e.g. "unmounted" stamp dies) and magnetic materials already on the market; thus eliminating the need to manufacturing new component parts. In addition, because of its simplicity and minimal components, this invention provides a quick and easy method for converting any existing stamp component system into effective magnetic stamp mounts.

One more object of this invention is to allow ease of conversion to magnetic means of manufactured stamps sheets for both larger scale fabrication as well as the individual consumer. For example, by the nature of their design, rubber stamp members 02 are typically cut out of larger sheets of flexible rubbery material holding many images on them. After cutting, these smaller image pieces 02 are glued onto separate stamp mounts 16. Consequently, regarding my invention, using said magnetic materials 08, which have similar cut and flexibility attributes will allow the traditional assembly of rubber stamps to remain substantially unaltered. For instance, during the manufacture of this magnetic stamp member holding and positioning device, these same stamp-die pieces 02 (even when fastened to magnetic coupling materials 08 can be cut and processed virtually the same way. The main difference is that said flexible, cutable magnetic material 08 can be fastened to these larger sheets prior to being cut into smaller pieces. These resulting larger combination sheet, 02, 08 units, can be cut as normal, where both materials being bonded together, will be little more difficult to cut than the rubber stamp die portion 02 by itself and manufacturers could easily convert chosen portions of their existing line of rubber products to a magnetic rubber stamp production with minimal cost and efforts and possibly without having to change anything at all. This would also be highly advantageous to the stamp consumer who also purchases stamps 02 in the form of larger sheets, which they will cut for themselves. These consumers would also save time and effort in their own "magnetic alteration" of existing rubber stamp members 02.

Another object of this invention is to provide an alternate use for transparent stamp mount alone to operate by itself as a functional semi-transparent magnet and consequently retain most of the strengths of a regular magnet with the added benefit of being partially translucent; this will allow the user to peer through the magnetic base cum magnet. These functional semi-transparent magnets will be especially useful in areas of use where magnets are not typically employed because they obscure vision, but where transparency is an asset.

Further objects and advantages of my invention will become apparent from a consideration of the drawings and ensuing descriptions of it.

BRIEF DESCRIPTION OF THE SEVERAL VIEWS OF THE DRAWINGS

List of Reference Numerals

02 stamp member-die
04 adhesive element for 06
06 magnetic coupling member
08 self adhesive unit of 06
10 magnetic connecting base
12 adhesive element for 10
14 self adhesive unit of 10
16 stamp mount
18 ferromagnetic connecting base
20 adhesive element for 18
22 self adhesive unit of 18
24 ferromagnetic coupling member
26 adhesive element of 24
28 self adhesive unit of 24
30 cushion material
32 transparent stamp mount overlay sheet
34 transparent stamp mount
36 patterns of 10 or 18 on 32 (version 1) Perforated/Expanded Sheet
38 patterns of 10 or 18 on 32 (version 2) Perforated/Expanded Sheet
40 patterns of 10 or 18 on 32 (version 3) Perforated/Expanded Sheet
42 stamp shapes and forms cut directly out of 06
44 magnetically attractive stamp member-die storage stamp mount
46 ferromagnetic material which attracts magnets
48 typical refrigerator
50 magnetic or ferromagnetic filament connecting base
52 stamp member die silhouette
54 semi-transparent magnetic mount unit
56 magnetic particles
60 lengthened patterns of 10 or 18 within 32 (version 1)
62 lengthened patterns of 10 or 18 within 32 (version 2)
64 lengthened patterns of 10 or 18 within 32 (version 3)
66 sticker/image reflecting stamp pattern of 02

DETAILED DESCRIPTION OF THE INVENTION

Figure 1A:
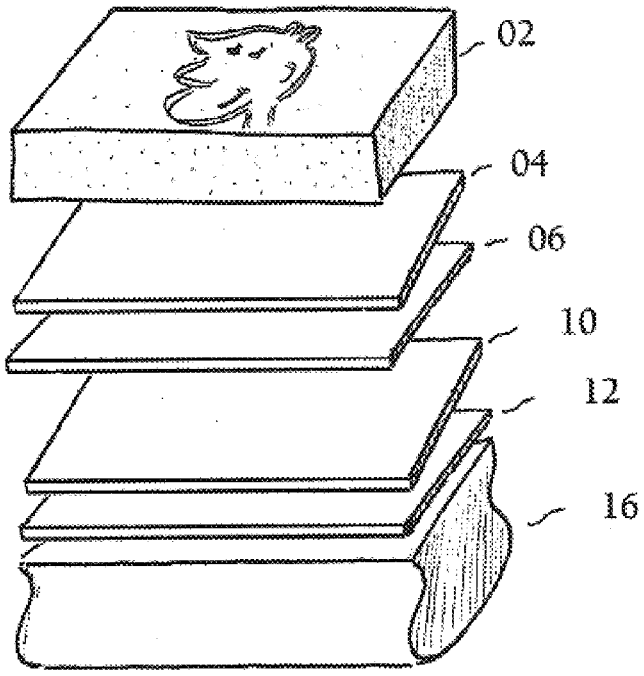
FIG. 1A is an exploded perspective view the component parts constituting the magnetic stamp member holding device invention, utilizing a magnetic base connector 10, where the adhesive elements 04, 12 are shown as individual components demonstrating their preferred positioning.

Referring to the drawings, the primary rubber stamp components, of the stamp member-die 02 and the stamp mount 16, when properly fastened to their respective magnetic materials, each will effectively attract the other—in a magnetic way—and will exhibit all of the benefits that a magnetic bonding will provide. As such, the magnetic component parts of this invention, be they permanent magnets, magnetic materials with permanent particles imbedded within them, or ferromagnetic materials—those iron bearing ferromagnetic materials which attract magnets and magnetic particles—should be considered to have opposing polarities aligned within my invention in such a way as to be attractive to each other. Put in a different way, the magnetic parts need to be placed so that one component of a negative polarity faces its partner component which has a positive polarity—an "opposites attract" situation, so to speak. In addition, it should be assumed that any magnetic stamp fastening mechanism employed within this invention will include all functional attractive combinations of magnetic and ferromagnetic material pairings without varying from the essence of this invention; this includes magnet to magnet pairings. Consequently any magnetic material used in this invention can be substituted with a "counterpart" material of similar polarity as long as either component faces its appropriate partner magnetic material of appropriate polarity; this is because of the comparable attractive properties between magnetic and iron bearing ferromagnetic materials. In addition, due to the reciprocal nature of magnets and magnetic elements, both the coupling and base pairings can be "reversed", so to speak, so as to allow the base to provide the principal attractive magnetic component, or even function as a stand alone functional magnet.

In a related manner, the following refers to all drawings FIGS. 1 through 3. Those illustrations labeled "A" will refer to the magnetic base connector material of this invention being composed of either a permanently magnetized material, such as a permanent magnet, or a material with permanent magnetic materials imbedded within it (of that kind that are the composite materials which comprise typical "magnets" on the market today). All illustrations labeled "B", on the other hand, be they partial or full images, will refer to the magnetic base connector material of this invention being composed of a ferromagnetic material. For purposes of simplification, said "B" illustrations have the same image (or portion of the image) being repeated, with only the single magnetic base connecting component being "swapped" with a ferromagnetic material. In addition, there is a third situation (not illustrated) where dual magnetic elements of opposite polarities are paired to create a magnetic attraction of the component stamp parts. Since this latter combination operates in the same manner as does a magnet/ferromagnet situation, one need only change the nomenclature of the select component material (from ferromagnetic material to magnetic material) all other aspects will remain unchanged. Consequently, further analysis is considered unnececary. Nevertheless a magnet to magnet situation should be recognized as being a quite usable combination to this invention, thus, wherever a typical magnet/ferromagnet situation is described, there should remain an unstated implication that a magnet to magnet situation could also be employed. However, after having said that, in order to avoid subsequent repitition, there will be no further analysis depicting any variant magnetic material pairings. Those skilled in the arts of magnets and magnetic materials, will have no trouble choosing appropriate pairings which will most effectively address the magnetic attraction issue.

In addition, I use the term "stamp mount" throughout this invention description instead of the term handle. This is because, depending upon its usage, and in keeping with current rubber stamp terminology, this seems to offer the best description of the units function. In large manufacturing utilizing large scale stamping, a "handle" would have little usage since the rubber portion of a stamp would be fastened to a stamping base machinery portion, or positioning "mount". In personal consumer stamping usage, the stamp is mounted to what will be grasped by hand, naturally termed a "handle", in the vernacular, but it is still a "mount" for the stamp member-die, no less. I also refer to the rubber stamp portion of this invention simply as a stamp member-die. This is because, the term "die" is the typical descriptive term for the ink receiving portion of a rubber stamp; Since these components are basically being fastened utilizing magnetic components, they can be correctly referred to as "magnetic stamp mount and magnetic stamp member-die of this invention. Howerver, for simplicities sake, and to avoid nomenclature overkill, the term "magnetic" will typically be left out the descriptions, without implying any reduction of component parts.

It should also be noted, for additional clarity, that the element of a cushioning material 30 of a typical rubber stamps is not included in most drawings of this invention. This is because a stamp cushion 30 can be placed in numerous positions (e.g. either fastened to the stamp mount 16 or to the stamp member die 02, or to both, not shown), or it can be eliminated altogether and still have has little operative bearing on the function of the invention itself. This is because the typical rubber material used to make stamp member dies 02 usually provides enough impact absorbency and ink transfer potential by itself. However, stamp cushions 30 are more often used on rubber stamps as a image quality aids (for crisper lines and images), as well as a type of comfort preference option, to provide that "cushy feel". Generally, rubber stamp cushions 30 are affixed between the stamp member die portion 02 and the stamp mount 16 (unless the stamp utilizes a form of enlarged cushion which serves as a stamp cushion/mount, as is often the case in some stamps, as seen in FIG. 11*z*). However, since a magnetic stamp mount unit comprises two parts—the magnetic stamp mount unit and the magnetic stamp member die unit—the stamp there is more flexibility as to the placement of any cushioning apparatus 30 as mentioned above (as long as the magnetic components remain onubstructed).

Finally, while there may be instances where the magnetic portions can, and may be covered by other elements (such as with paint, stickers, etc.). This may be for the purpose of decoration aesthetics, placement markings, or some other purposes (if the covering is thin enough and of a nature which does not seriously reduce or eliminate the magnetic attraction of these paired magnetic components). However, generally speaking, the magnetic portions of this invention are intended to remain "clean", so to speak, with any other components consistently being placed "opposite" the magnetic joining surfaces. This way the magnetic components will retain their full attraction properties, magnetically unhindered by other components or materials. Last, since numerous alterations and changes in form, details, arrangements and proportions will readily occur to those skilled in the art, it is not desired to limit this invention to the exact construction and operation shown and described, accordingly, all suitable modifications and equivalents may be resorted to, falling within the scope of this invention as claimed.

Figure 1B:
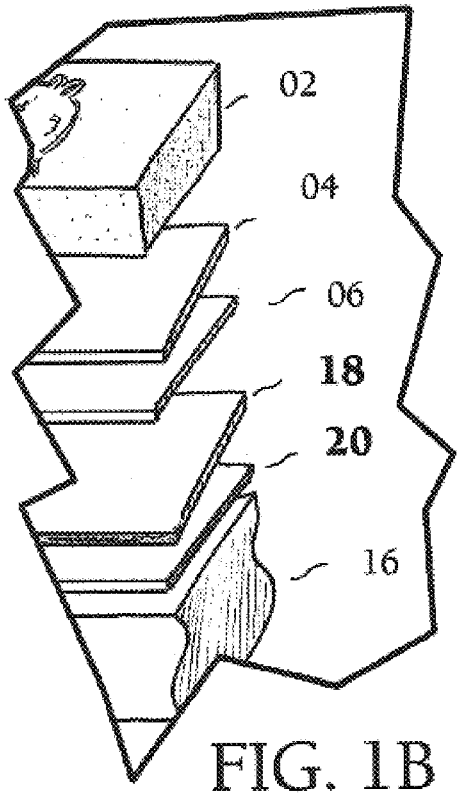
FIG. 1B is a partial exploded perspective view of the component parts constituting the magnetic stamp member holding device invention, utilizing a ferromagnetic base connector 18, where the adhesive elements 04, 20 are shown as individual components demonstrating their preferred positioning.
Figure 2A:
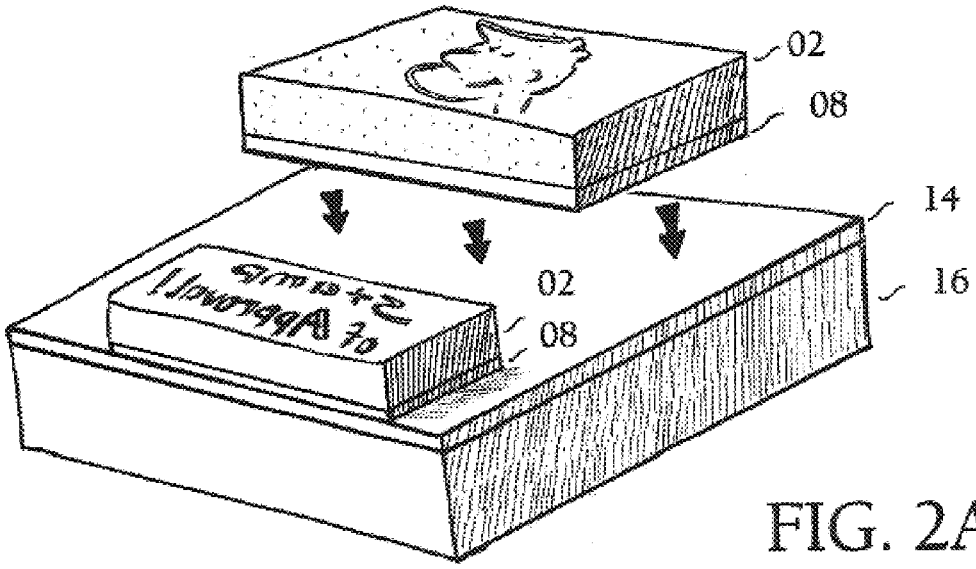
FIG. 2A is a perspective view showing the magnetic positioning nature of a magnetic stamp member, or members, of this rubber stamp invention utilizing a magnetic base connector, shown as one self adhesive unit 14.
Figure 2B:
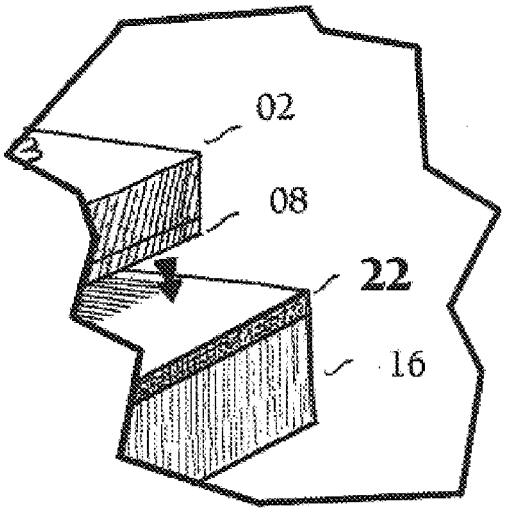
FIG. 2B is a perspective view showing the invention utilizing ferromagnetic base connector, shown as one self adhesive unit 22.

FIGS. 1A and 1B illustrate the first embodiment of the present invention where the component parts include the following: Numeral 02 denotes the stamp member-die—any rubber-like material with a raised "mirror-image" delineation designed to hold ink from an ink pad and transfers a "corrected" ink line image onto another surface. The stamp member should have a characteristic a low rebound, low compressibility, one which will hold a high definition reproduction of the transferred image onto another surface. The stamp member-die 02 is regularly produced out of red rubber, or less expensive photopolymer; however many substances will work well and will effectively hold ink for a stamp. Even homemade cut vinyl erasers and typical rubber magnetic sheets (flexible magnetic composite materials which have magnetic particles imbedded in them). The primary removable magnetic "coupling" component of this invention is numeral 06. This is composed of a properly aligned permanent magnet or a permanently magnetized material which is conventionally attached to said stamp member 02 using a secure commercial adhesive material (represented as) 04. A magnetic base connector, 10 or 18, is preferably constructed of a sheet of properly polarized permanently magnetized material 10, or ferromagnetic (magnet attractive iron bearing) material 18, which is also designed to be securely and adhesively affixed to its respective component (the stamp mount 16) of this invention. Similarly, said magnetic base connectors, 10 or 18, utilize a comparable adhesive means (represented as) 12 and 20, respectively, to be fastened to said stamp mount material. Numeral 16, denotes the stamp mount for this magnetic stamp invention. The stamp mount 16 can be constructed in any shape and form and using any number of materials normally used as rubber stamp mounts. Materials such as a foam block, wood or clear acrylic work well, although virtually any substantially solid material will do.

As a unit, the two magnetically attractive components of a stamp member die and a mount (each with their own respective magnet, or paired magnet attractive material fastened) provide the principal novel aspect of my invention; that being this invention takes advantage of the fully flexible nature of magnetically fastening. Referring to FIG. 1A and FIG. 1B, these illustrations imply separate adhesive materials 04, 12 and 20 being fastened to their respective magnetic components of this invention. For instance, adhesives 04 and 12 would function quite effectively as pressure sensitive double sided self-adhesive strips which would fasten both respective planar facing surfaces of 02, 06 components and 10, 16; and likewise adhesive 20 would equally fasten planar facing surfaces of 18,16 (pressure sensitivity and self adhesiveness, while not required, being beneficial). However, the primary intent of these first illustrations is to visually depict the relative positioning of the adhesive elements of this invention. With this in mind, numerals 04, 12 can also be considered as symbolic representations of areas a typical adhesive will be placed in this invention. If the adhesive were able to "free float" it would take the very positions, in space, as shown in the illustrations as defined by numerals 04 and 12 or 20. Regarded in this way, one can see that the adhesives should be sandwiched between two respective components, one on the stamp member-die coupling component (between 02 and 06) and the other on the magnetic connecting base component (between 10 and 16; or between 18 and 16, respectively). Thus, the magnetic components will maintain a "clean" magnetic "front side" for its magnetic component to magnetically bond with its partner magnetic element, with appropriate adhesive elements relegated to the "back side". The types of adhesives required for fastening the magnetic parts of this invention to parts which are supposed to be securely fastened, should be considered, on a functional basis, to be permanent, where the adjustable removable nature of this invention is solely accomplished through the magnetic attraction of the two respective magnetic components only. With this in mind, and for further simplification, future descriptions describing adhesive fastening, will depict, the fastening of the magnetic elements of this invention utilizing pressure sensitive, self-adhesive magnetic fasteners, where the magnetic elements are appropriately fastened to their respective parts. And finally, it should be reminded that the above, while highly endorsed (especially as a method for the home stamp user to modify their existing stamp components to a magnetic means) this should not be construed as limiting, but rather as indicators of one preferred method; doubtless, manufacturers and those skilled in the arts, will doubtless, have knowledge of what materials and bonding agents work best.

Referring to FIGS. 1A and 1B again, this time regarding component parts: Stamp member-die unit 02 is attached to magnetic coupling member 06, using adhesive 04, functionally, we are left with a the magnet-fastened stamp member-die, combination unit of 02, 04, 06. In like manner, magnetic connecting base 10 is equally fastened stamp mount 16 with an adhesive, resulting in stamp mount combination unit of 10,12,16. In the same way, alternate stamp mount combination unit (FIG. 1B) includes: ferromagnetic stamp connecting base 18 being fastened to stamp mount 16 with an adhesive 20, resulting in stamp mount combination unit of 18,20,16. When said composite "pairs"

are placed together, (either units 02, 04, 06 to 10,12,16; or 02,04,06, to 18,20,16, respectively) with their magnetic surfaces placed "face to face", these two combination units will magnetically attract themselves to form a solid and immovable, yet freely removable bond, where together these operative compound parts function as a single unit—the magnetic rubber stamp. In sum, this invention becomes a magnetic stamping unit which enjoys all the benefits that a magnetic fastening will offer, not the least including the ability to quickly, easily, and conveniently reposition, combine, remove and manipulate single and multiple member-dies (stamping surfaces) on a single stamp mount, the stamp mount (mounting-base or handle).

The above description describes two (2) compound magnetic units being utilized in this invention, but demonstrates three (3) numeric sets of compound magnetic components: unit 02, 04,06; unit 10,12,16; and unit 18. 20, 16. This is, of course, because of the complementary attractive nature of magnets and ferromagnetic materials, as discussed above, and the "third" set of compound component parts, unit 18, 20, 16 (composed of a ferromagnetic iron containing base connector), will functionally perform the same as the "second" unit 10,12,16 (composed of a magnetic base connector), that is to say, to magnetically attract the "first" compound unit 02, 04, 06 to the stamp base connector set. Thus, while there are, indeed, three (3) main components that would cooperatively work in this invention, only two will operate in unison. On a functional level, there are only two (2) operative components to this invention; they are, for lack of a better description, the "magnetic stamping die" (02, 08) and its partner "magnetic stamp mount" (14, 16; or 22, 16).

Also we should keep in mind that precisely because of the reciprocal nature of magnetic elements, either stamp component set, the stamp mount portion, or member-die portion, could utilize their respective "partner magnetic material" and function equally well. This becomes very important later on when looking at the alternative embodiment of this invention in stand-alone fashion, where each part utilizes appropriate magnet materials and exploits their respective stand-alone potentials.

Referring to FIGS. 2 through FIGS. 3 again. The self-adhesive element described above, by its nature of being an incorporated element, will reduce in number component parts, where instead of three individual parts making up a compound parts, there will only be two. Thus, these parts can be re-designated as follows: magnet-fastened stamp member-die combination unit 02, 04, 06, will now be considered 02, 08 (where self-adhesive magnetic coupling unit 08 replaces 04 and 06), stamp mount combination unit 10,12,16 will be 14,16 (where self-adhesive magnetic connecting base 14 replaces 10 and 12) and its functionally alternate stamp mount combination unit 18,20,16 become 22,16 (where self-adhesive ferromagnetic material 22 replaces 18 and 20). Even with a reduction of adhesive components as described above, there still remain only two (2) main compound parts of this invention which function as the magnetic fastening pair—the magnetic stamp member-die unit and magnetic stamp mount unit, respectively.

Referring to FIG. 2A, 2B, 3A and 3B, these demonstrate the dynamic, variable, and flexible arrangement nature of a magnetic stamp invention. Thus, the sizes and quantities of the stamp member coupling units 02, 08 are changeable and varied and there is no restriction on the size or shape, or arrangement of the stamp mount, or strengths of magnets used. While illustrations and descriptions cannot fully detail the entire benefits of magnetically bondable nature of this invention, it is hoped that they can, at least, provide some examples of the benefits which a magnetic fastening of stamp parts will produce.

Figure 3B:
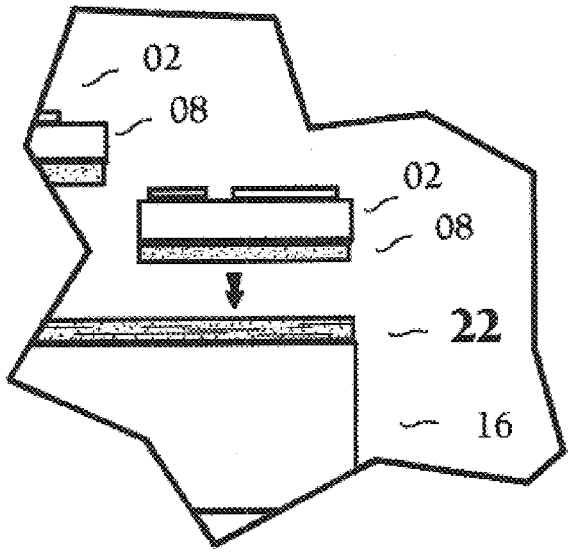
FIG. 3B is a partial vertical sectional view showing the invention utilizing ferromagnetic base connector, shown as one self adhesive unit 22.
Figure 3A:
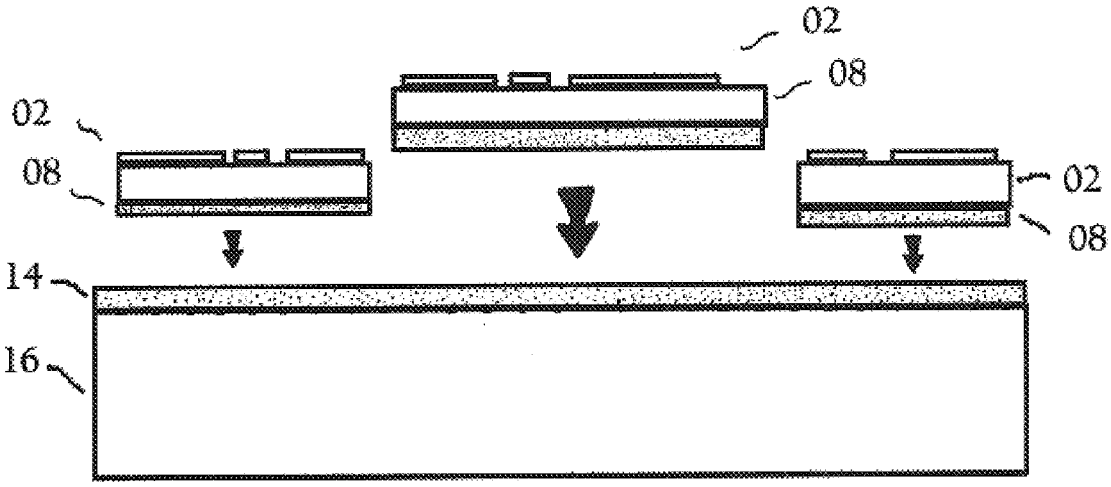
FIG. 3A is a vertical sectional view showing the invention from the side and further demonstrating the magnetic attraction elements of this design utilizing a magnetic base connector, shown as one self adhesive unit 14.

Referring to FIG. 3A and FIG. 3B, these are vertical cross sectional views of the components of the invention. In addition to further demonstrating the method of magnetic attraction utilized for the stamp base connector, the illustrations also demonstrate the basic two-component system of this invention. As indicated by the drawing, the stamp member-die unit 02, 08, or a plurality of stamp member-die units 02,08, are magnetically attracted to the magnetic stamp mount unit 14,16, or the same unit 02,08 can be attracted to the ferromagnetic stamp mount unit 22,16. Again, as can be seen in these illustrations, the only structural change between the two forms of this invention is the change from the magnetic base connector material 14 to a ferromagnetic (magnet attracting—material) 22. And accordingly, depending upon which paired materials are used, the magnet strength and polarity will be adjusted accordingly. Again, those skilled in the arts of either, will have no trouble here.

Referring to FIGS. 5 through 9. As described in detail, in the prior art section of this invention analysis, sometimes a transparent stamp mount 34 is used by consumers. For many, the use of a transparent handle provides an advantage in accurately placing their stamp images onto their stamping surface, generally of paper or other material. The user simply peers through the back side of said clear stamp mount 34 (viewing the "backside" silhouette shape of their stamp member) and can consequently predict and manipulate the positioning of their stamp image member 02, with a high degree of control. As described above in the prior art, there are a number of stamp die mounting strategies utilizing clear mounts 34, from the temporary to a permanent fastening. However, these methods are somewhat limited regarding easy stamp member-die repositionability and combinability. FIGS. 5 through 9, accordingly, are some examples of structural variations of this invention which allow, much freedom and control of combining, positioning, repositioning and manipulating, of single and multiple magnetic stamp images units 02,08 onto a clear stamp mount 34, while at the same time maintaining a very high degree of visibility. These are only some samples, many different patterning and materials may be used, such as perforated materials, expanded metals, screens and so on. The main concern here is that the materials provide enough planar surface to adequately attract and hold a functional-magnet, per se'. Those skilled in the arts will be able to device material pairs which best exploit both highest magnetic adhesion as well as maintain the maximum visibility quotient.

Figure 5:
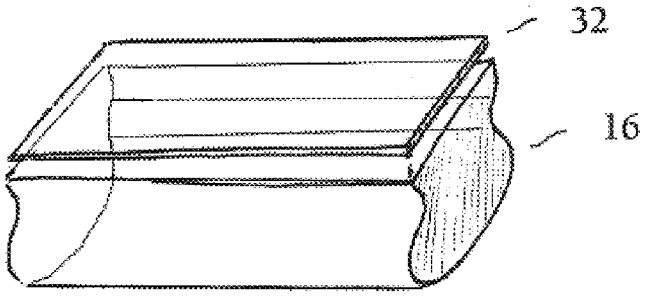
FIG. 5 is an exploded view of the optional transparent stamp mount components, where a transparent mount overlay sheet 32 is being attached to the transparent stamp mount 16.

Nevertheless, before further considering the magnetic alteration of a clear stamp mount 34, we should consider FIG. 5 in depth. FIG. 5 demonstrates an exploded view of one of the optional transparent stamp mount component add-on. Here a transparent mount overlay sheet 32 is being attached to a transparent stamp mount 34. A clear transparent mount overlay sheet 32 is key to modifying existing clear stamp mounts 34 to magnetic means as well as creating a simple way of assembling new clear stamp mounts 34. A thin "add-on" sheet can be easily added to an existing clear mount by a consumer who already has a selection of said stamp mounts 34. Additionally, for larger scale manufacture and modification, where manufacturers of existing clear stamp mount handles 34 merely have to affix a magnetic material-modified clear overlay sheet to their existing clear stamp mounts 34 to convert said mounts 34 to "magnetic mounts"; consequently this latter group would not have to significantly alter existing manufacturing machinery or purchase much new machinery. Nevertheless, while a transparent mount overlay sheet 32 is beneficial and convenient, especially regarding the modifying existing clear stamp mount 34 to a become magnetically attractive, it is not a necessity; the visibility through a clear stamp-mount handle 34, would be virtually unchanged whether the magnetic elements are fastened to said clear stamp mounts 34, with added clear oversheet 32, or not. In fact, in regards to new manufacture of "magnetic" clear stamp mounts, fastening a magnetically attractive base material directly onto a clear mounts (minus the oversheet), may be preferable. In addition to being able to modify existing clear mount manufacture to a magnetic means, the following should also be considered as an indicator of function, maintained benefits, and a general "positioning" plan for the placement of patterning of magnetic elements onto any form of clear mount-handle (and for that matter, for fastening of similar magnetic materials onto an opaque handle, should this be desired). And, of course, any configurations, thicknesses, shapes, patterning, or manufacturing method of creating the transparent magnetic components of this invention, as with all other concepts, are intended to demonstrate suggested, not limiting, examples of these embodiments.

Figure 6:
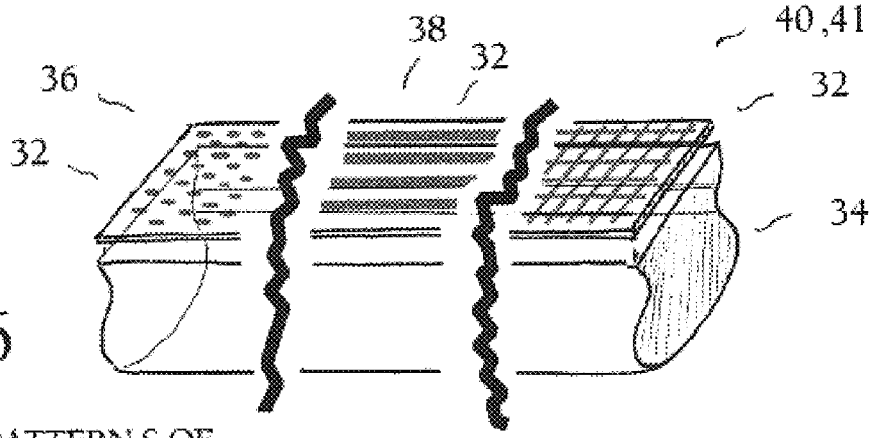
FIG. 6 is a perspective view of transparent mount overlay sheet with the magnetic connecting bases—in the form of imbedded patterns of magnetic materials 36, 38 and 40, or as a similarly patterned perforated/expanded metal sheet material 41—fastened (versions 1–3).

Referring to figure FIG. 6. For simplicities sake the following descriptions will be limited to the three variations; and accordingly, each will be considered separately.

Referring to Figure FIG. 6. This image shows a partially exploded perspective view of a transparent mount overlay sheet with three versions (36,38,40) employing magnetic connecting bases. This image is a representative sample of the patterning of connecting base materials that may be fastened, or imbedded, onto a clear transparent mount overlay sheet 32, thereby adding the element of a magnetic attraction to a transparent stamp mount 34. The first scheme of patterning on a clear material 32 can take the form of "spotting" of magnetic, or ferromagnetic, materials as indicated by numeral 36. The second scheme of patterning on said clear material 32 can take the form of "stripes" of magnetic or ferromagnetic material as indicated by numeral 38. The third scheme of patterning on a clear material can take the form of "gridding" of magnetic or ferromagnetic material as indicated by numerals 40. This gridding pattern can be accomplished through a means of actually forming grid layers of appropriately magnetic material in a desired pattern onto said transparent oversheet during manufacture; or better by attaching a form of pre-manufactured perforated magnetic sheet material, or expanded metallic sheet, to the specified location of said clear material (either clear oversheet or directly to translucent mount-handle itself). The holes within said perforated, or expanded, metallic material result in a high visibility through the material itself and can produce a "grid pattern" as well. Although for the purpose of illustrating a grid pattern, the perforations have been shown using "square-like" holes, these perforations can also be circular (typical of perforated materials), or other polygonal shape (as is commonly manufactured and not shown); many variety of metal perforated shapes, or expansions will suffice. Still, a solid sheet of appropriate magnetic or ferromagnetic sheet should be perforated or expanded in such a way as to allow a high visibility ratio through said material (somewhere in the neighborhood of a 50% or higher ratio). Uniformly perforated/expanded sheet material may actually be the best, because it provides a "built-in" positing grid which would further add to the advantages of positioning using a transparent stamp mount 34. Additionally, any "spots" or stripes could also be sized or aligned, or manufactured, so as to appear in the form of a useful "grid"; or for that matter, they may create any desired pattern (e.g. to form a recognized "image" from magnetic patterning (not shown).

Said patterns of laying down magnetic material on a mount can be of any size, thickness, or orientation, even a combination these variations or patterns so as to maintain an adequate surface coverage of said transparent mount overlay sheet 32, or stamp mount itself 34. Additionally, the individual shapes of each pattern element, the "spots", need not be limited to forms described above; these individual pattern elements could also be in the form squares or rectangle, triangles, or any polygon, and some configurations may lend themselves better to creating magnetic attraction, or manufacture. Those skilled in the arts will surely know which configurations will work best. Nevertheless, regardless of their configurations, said patterning needs to be adequately placed so that said patterning provides many contact points, for the stamp-member die unit 02,08 (regardless of any given position said stamp-member die unit is placed in). In this way a firm magnetic attraction of components will be maintained. Generally, the more contact points, the stronger the magnetic bond (considering the strength of the magnets used). Again, the main considerations, aside from aesthetics, would be to present the largest total surface coverage possible of magnetic, or ferromagnetic, materials over the clear mount elements, 32 or 34, in order to create the most effective attractive surface to the complementary magnetic stamp member-die components 02,08, while maintaining high visibility. The best situation provides an ideal combination of many contact points and magnet strength, without sacrificing visibility through the translucent stamp mount material, 32 or 34 respectively. Of course, all of the preceding descriptions and arrangements can be transferred to an opaque, non transparent mount 16. However, the "see-through" benefits of such a mount will be absent, of course.

Figure 7:
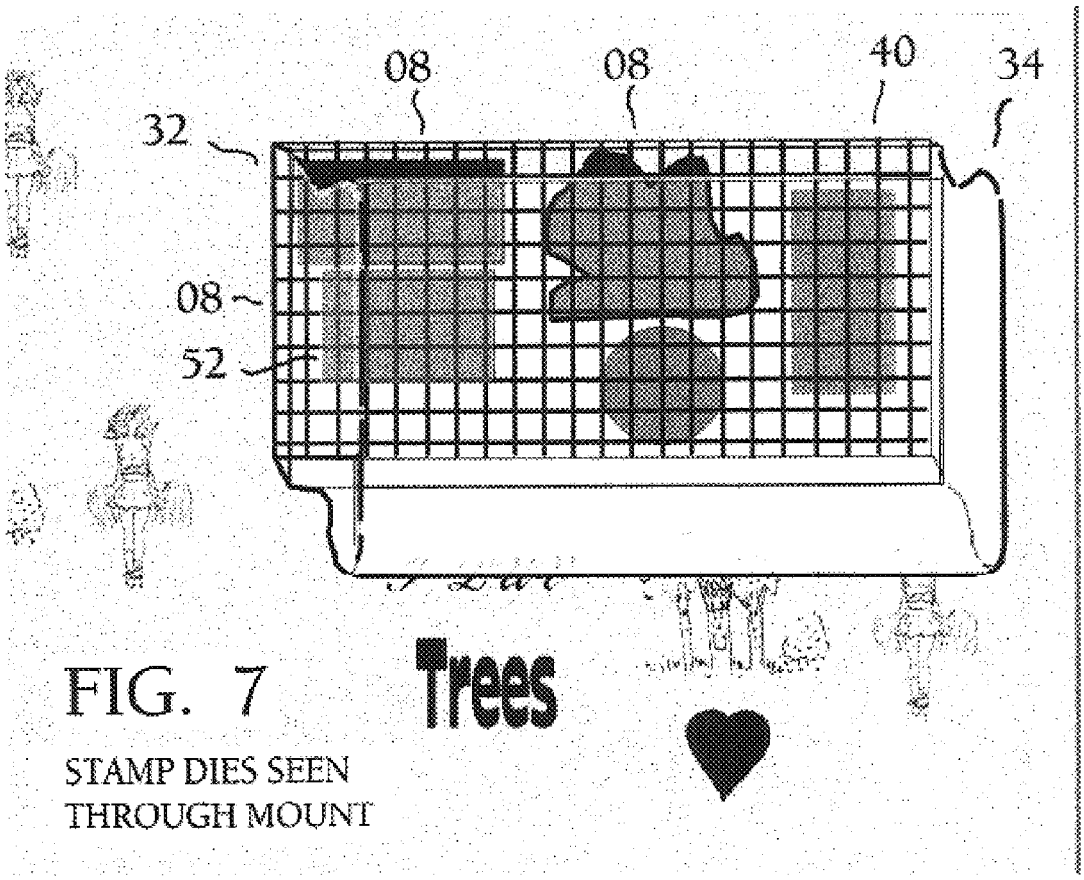
FIG. 7 is a perspective view showing how the stamp member-die components 08 can be seen through a transparent stamp mount 34 and transparent overlay sheet 32.

Referring to FIG. 7. This is a perspective view exemplifying how the magnetic stamp member-die units 02,08 can be seen "through" a translucent stamp mount 34 utilizing attached grid of perforated, or expanded magnetic sheet material 40 (regardless of whether it utilizes a transparent oversheet 32 or not). This image is pretty self explanatory. It is worth re-emphasizing that, contrary to solid handles, a clear handle allows one to see the back-side of a stamp member-die 02 and allows for ease of accurate placement. And while a stamp member-die by itself is actually an image in reverse, when looking at its back-side, through a clear handle 34, one will see the "corrected" silhouette 52 and direction of the resulting stamp image as it will be seen when "stamped" on the targeted surface.

Figure 8:
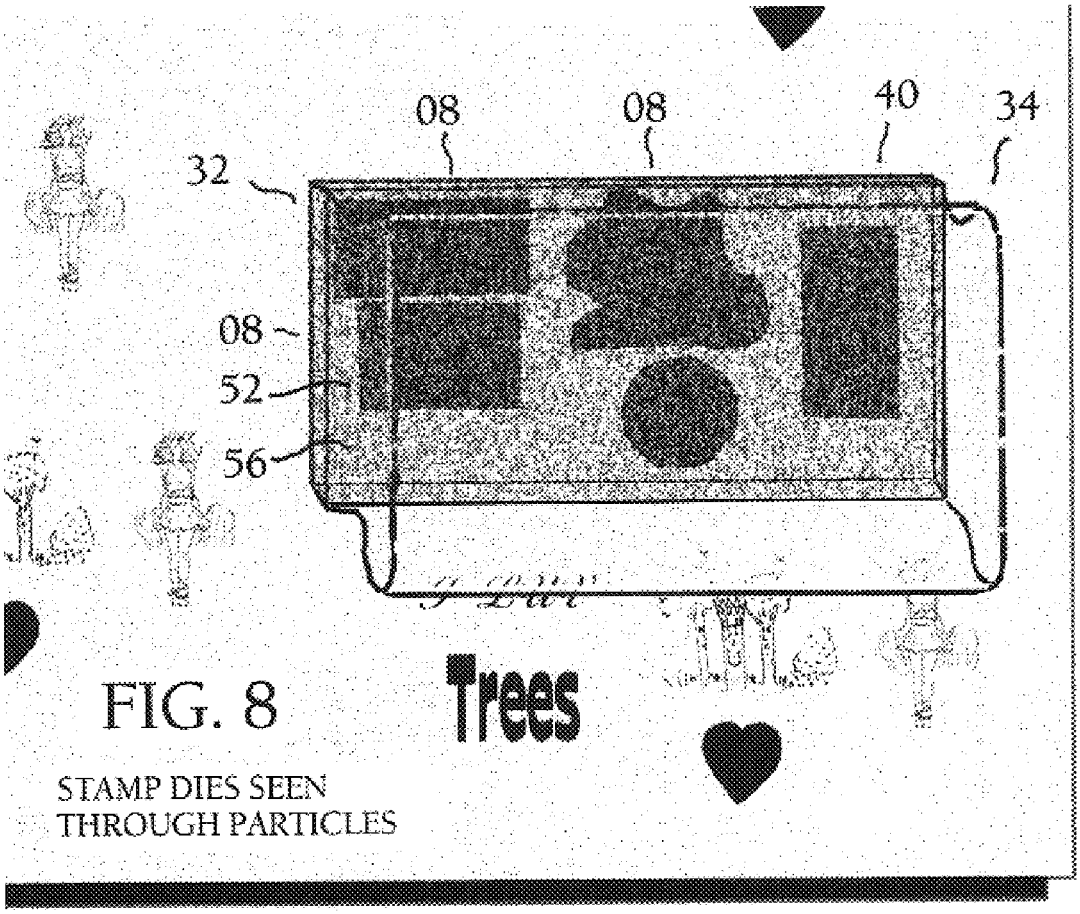
FIG. 8 is a perspective view showing how the stamp member-die components 08 can be seen through a transparent stamp mount of imbedded magnetic particles 56 when looked at from partially overhead.

Referring to FIG. 8, this is a perspective view exemplifying how the magnetic stamp member-die unit silhouettes 52 can be seen through a transparent stamp mount where magnetic elements are very small, here termed magnetic particles 56. Such magnetic particles 56 are imbedded into the clear oversheet 32 in the form of a semi-transparent magnet. Here, the appropriate magnetic elements 10,18, this time in the form of the magnetic particles 56 themselves, could be satisfactorily imbedded into a translucent material stamp mount 34, such as acrylic. As with the above descriptions, there would have to be an appropriate combination of quantity of imbedded particles as well as strength and of magnetic elements themselves. Those skilled in the arts, again, will be able to create an advantageous combination of the two requirements. Nevertheless, visually speaking while the resulting "pattern" of imbedded particles 56 in said stamp mount 34 would have more of a general "smoky" look to it, will still retain a high degree of useful visibility through said stamp clear material (e.g. stamp mount 34).

This illustration, indicates said magnetic particles 56 are imbedded into the clear oversheet 32, but of course, they could also be imbedded directly into said stamp mount 34. Imbedding magnetic particles 56 directly into a translucent material does not significantly reduce the corresponding magnetic attraction of the said magnetic particles 56 themselves. Again, the main concern when creating an effective magnetic attraction in this transparent medium is to find that "middle ground" between maintaining visibility while retaining sufficient magnetic attractiveness for the stamp member-die units 02,08. Here, as well as for the other patterning methods of magnetic elements as described in FIG. 6, there is a bit of range to work with. However there are a few methods which will help increase the relative magnetic attraction, while significantly preserving a high degree of visibility. One method is having the magnetic particles 56 of a translucent stamp 34 be positioned very close to the surface whereby increasing the magnetic attraction of said magnetic particles 56 (not specifically shown). Other methods are described in detail in FIGS. 9 and FIGS. 10.

Figure 9:
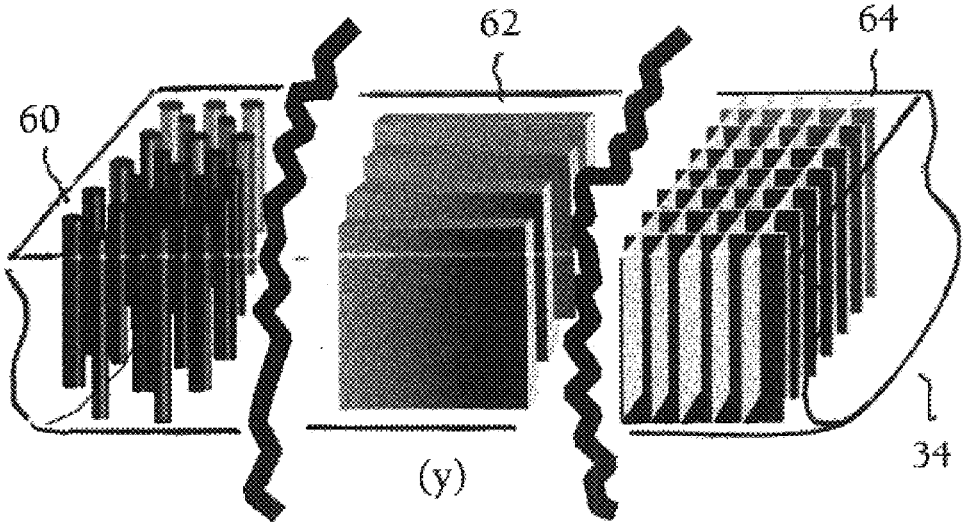
FIGS. 9*y* and 9*z*. Illustration "9*y*" is a perspective view showing the three versions of pattering shown in FIG. 6 when said patterns 32,34,36, (shown imbedded in a transparent stamp mount 34) are lengthened to create increased magnetic attraction of components, now 60, 62,64 transformed into rods, plates and interlaced plates. Illustration "9*z*" shows an "overhead view" of how the respective components will look like as seen through a transparent stamp when viewed from above.
Figure 9:
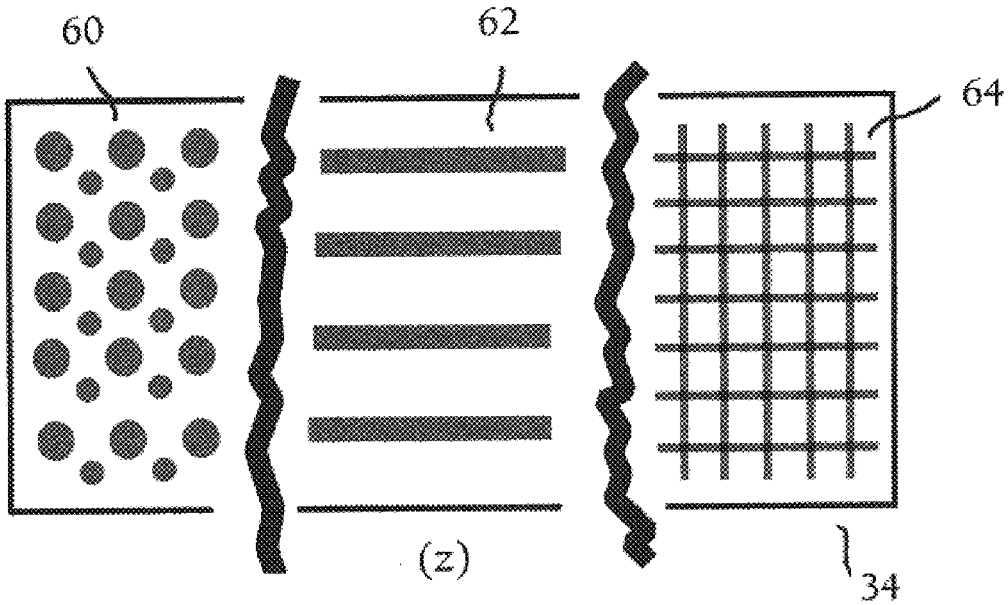
Figure 9:
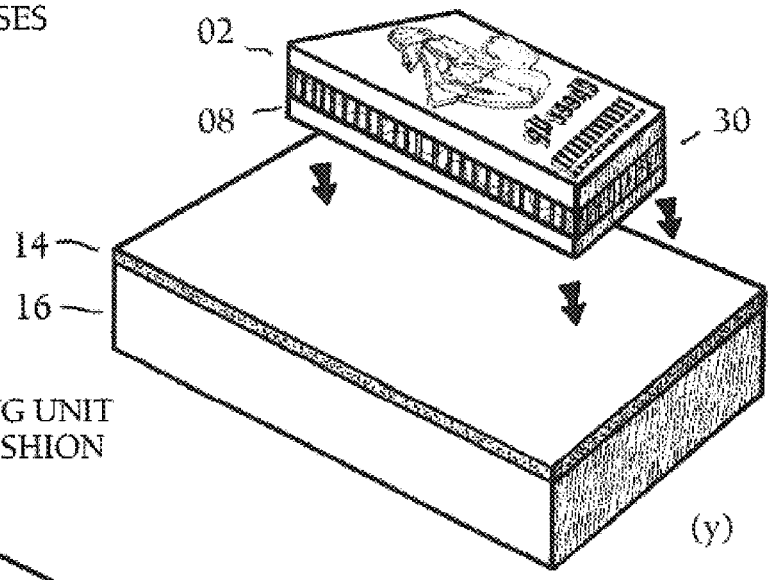
Figure 10:
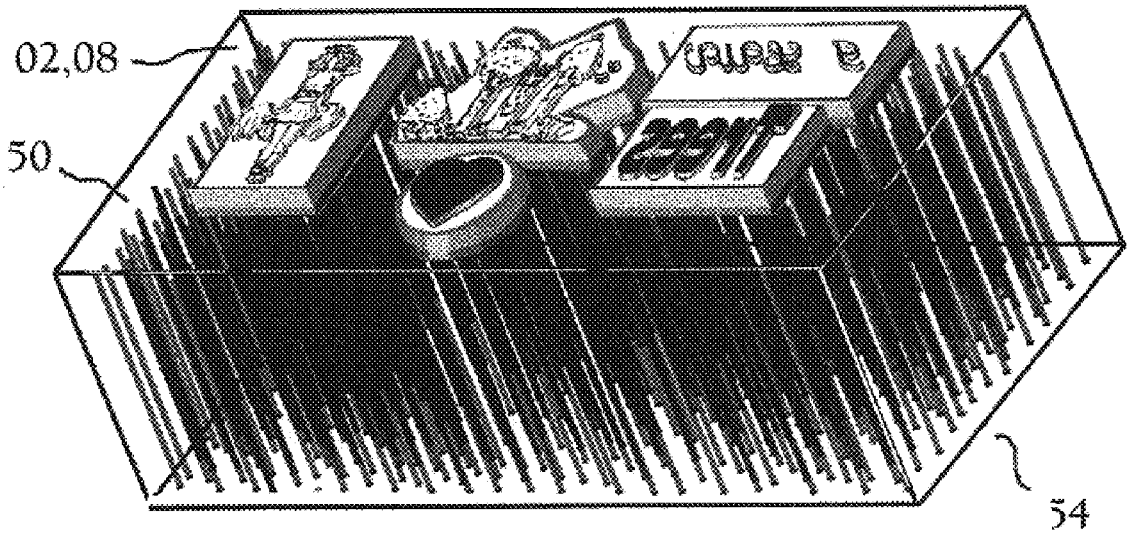
FIGS. 10*y* and 10*z*. Illustration "10*y*" is a perspective view showing the patterning shown in FIG. 8 when said particles 40 are lengthened to create increased magnetic attraction of components now 50 transformed into threads; the embodiment of imbedded threads being utilized for increased point-to point magnetic attraction of components. Illustration "10*z*" shows how the filaments respective will look as seen from overhead viewed through a transparent stamp.
Figure 10:
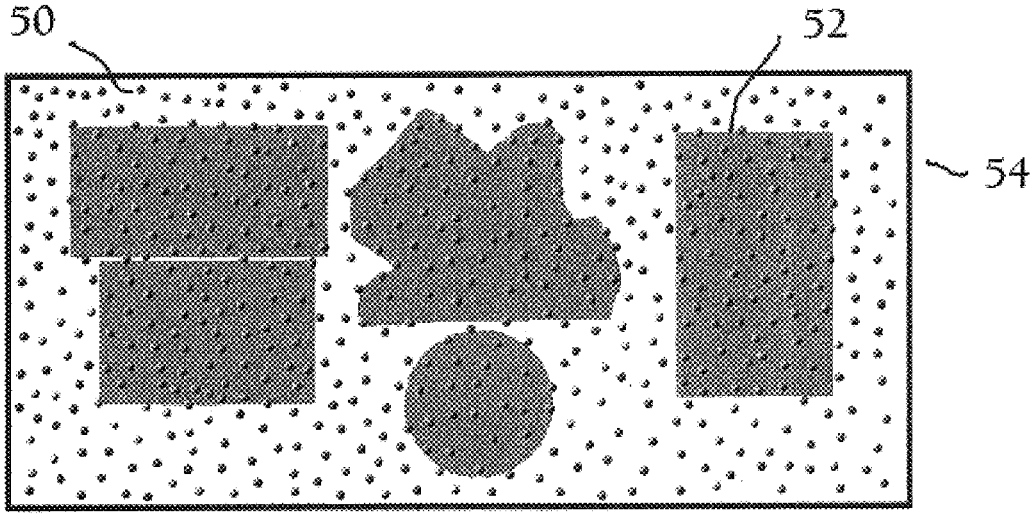

Referring to FIG. 9*y* and FIG. 10*y*, the following descriptions apply to lengthening of magnetic elements of this invention. With this in mind, thinking of identical magnets being stacked in vertical rows will be helpful, especially when all magnets have their respective polarities properly aligned and where all magnets are magnetically linked together in unison. Just as stacking to two magnets will provide a stronger combined magnetic attraction at their base than a single magnet will provide and where three magnets in unison provide a stronger combined attraction than two and so on, the lengthening the magnetic elements of properly aligned magnets will substantially increase the magnetic attraction of the base portion of each respective magnetic element in the transparent stamp mount 34. Equally, very long, narrow—"micro-thin"—magnets could be imbedded throughout the entire height of said translucent stamp mount 34, where the magnetic particles 56 imbedded within therein have a proper linear magnetic polarity running the entire length of said "micro-thin" magnetic elements, where the resulting magnetic attraction would be substantially increased. Thus, lengthening the vertical proportions of the magnetic patterns (60, 62,64)—will allow said lengthened patterned element to have a significantly stronger attraction than the non-lengthened patterns of 36,38,40 will have (as illustrated in FIG. 6). Variations, such as the total vertical height of any magnetic components, or their corresponding widths, or patterns, could also be manipulated as necessary to provide an adequate balance between magnetic attraction providable, as weighed against remaining visibility through the translucent stamp mount 34, as described in FIG. 10, or for any clear mount-magnet scenario. In any case, the appropriate magnetic connecting base elements 06, 18, are imbedded, in an appropriate manner, directly into the interior of the transparent mount 34. And while the preceding modifications could also be made on an opaque stamp mount handle 16 and will retain all of the benefits described above, it will do so without the consideration of transparency.

As illustrated in FIGS. 9 and 10 (y and z respectively), regarding this form of magnetic component lengthening, while the ability to see through the translucent stamp mount 34 will still be partially obstructed when looking at said stamp mount 34 from the side (FIG. 9*y*). When viewed from the top, on the other hand (FIG. 9*z*), said stamp mount 34 will exhibit no increase in horizontal, or visual, surface area obstructions—thus, no more loss of transparency—than if the magnetic connecting base materials (36,38,40) were only superficially imbedded as shown in FIG. 06. In effect, when viewed from the top, the transparency of said stamp mount 34, will be visually unchanged from what it was if the elements were not "lengthened". This is because the horizontal surface area of each component of said magnetic materials (60,62,64) will not be altered, whereas only the "visually unchanging" vertical portions will be increased, "stretched", if you will. Thus, the "view" through the clear stamp mount 34 will be preserved while at the same time the magnetic attraction of said stamp mount 34 will be much stronger.

Referring to FIG. 9*y* and FIG. 10*y* again, in addition to the functional aspect of the above descriptions, this form of vertical lengthening of elements within a clear stamp mount 34 will also provide a purely aesthetically pleasing element to this invention's design, whereby the user can view the internal "workings" of the magnetic attracting base components. Children especially, and the young at heart, all like to "peer" into things as evidenced by the popularity of books with cut-away images and "X-rays". Not only will the stamp maker enjoy using this translucent magnetic mount unit 54, they will enjoy just looking at it.

Figure 11:
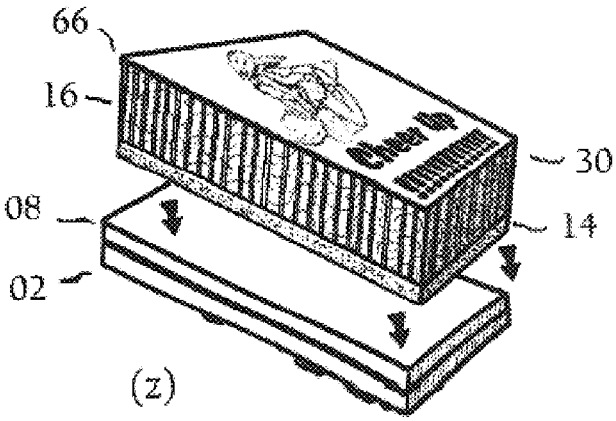
FIGS. 11*y* and 11*z*. Illustration "11*y*" is a perspective view demonstrating a suggested placement of the stamp cushion. Illustration showing the mount portion of the apparatus being fastened to the base unit portion. Illustration "11*z*" shows a variant of the stamp mount unit being a "combined" cushion and mount unit (a unit sans actual mount with an extended cushion instead).

Referring to FIGS. 11 (y and z). These perspective images demonstrate the preferred placements of a stamp cushion 30 in this invention, when said stamp cushion 30 is incorporated into the stamp invention. As can be seen here, the cushion is sandwiched between the stamp member-die 02 and the magnetic coupling element 02. In this manner, the resulting magnetic coupling unit 02,08 will, in effect become a 02,30, 08 combination unit (FIG. 11*y*) The preferred embodiment preserves the most effective attraction of the magnetic components described above as well as the most beneficial placement of the stamp cushion itself 30, in relation to the stamp member-die 02. Still the stamp cushion 30 could be incorporated other arrangements, without having a direct bearing on the invention's function; some examples including having the handle itself being composed of a thick block cushion or some other like spongy material 30—which acts as a "combined" cushion and mount, (FIG. 11*z*). Or the cushion component 30 could alternatively be fastened to the stamp member mount 16, being sandwiched between both the stamp member mount 16, said magnetic base connector material 14, becoming a 14, 30, 16 combination unit (not shown). Also stamp cushions 30 coould be attached to both mount and base units simultaneously (creating even more cushion effect). It should be noted that exclusion of the sponge elements, in the majority of illustrations for this invention, does not mean an exclusion of the stamp cushion 30 from this invention.

Referring to FIG. 11. The magnetic elements of this invention be reversed (or flipped) irrespective of their outer stamp components of stamp-member and mount, without effecting the function of this invention. Again, this is because of the reciprocal nature of magnets and magnetic elements. While this reversing of magnetic materials will function equally well, as far as magnetic attraction is concerned, and, using a ferromagnetic material for a stamp-member-die portion of the invention does provide one main disadvantage of not being so apt to be cut and manipulated. Thus, they would prove less useful in assembly and construction as rubber stamp die "add-ons" or modification of existing stamp member-dies, whereas the typical flexible composite magnetic materials, on the other hand, provide an ideal malleable add-on component for my invention.

Magnetic Stamp-die Storage Unit—Description

Figure 4:
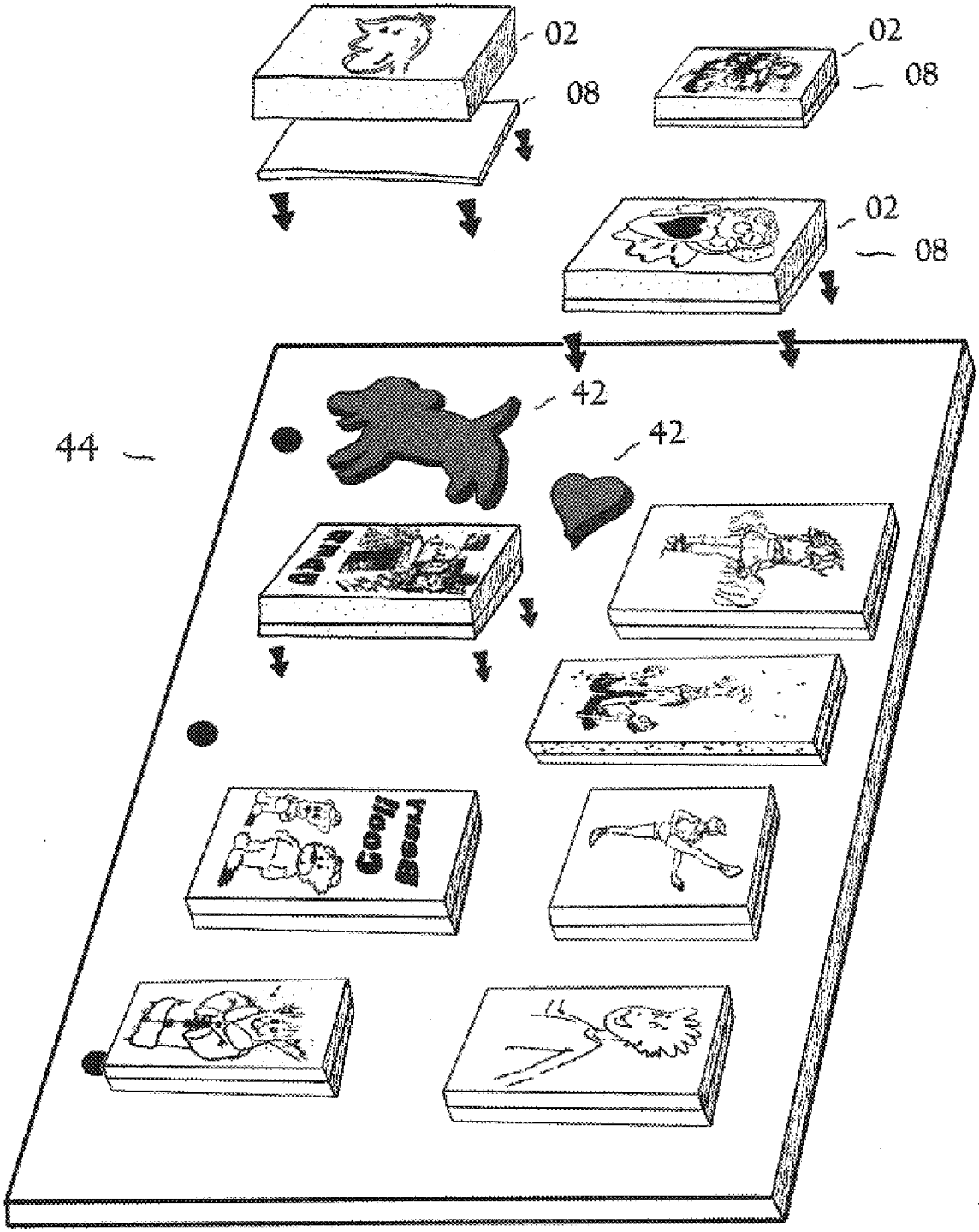
FIG. 4 is an exploded perspective view of the connecting base (composed of either magnetic or ferromagnetic material) as modified for stamp member-die storage 44. Attached are views of optional magnetic stamp forms and shapes created directly out of a magnetic stamp coupling material 42.

Referring to FIG. 4 This image details the second embodiment of this invention. Here, FIG. 4 reveals an exploded perspective view of the magnetic stamp mount unit 14, 16; or 22,16, as it can be structurally modified to become a large surface area designed for stamp member-die storage. Here it is shown how the stamp-mount 16, is merely a flattened and enlarged version of the magnetic rubber stamp mount—now 48. Functionally, the invention remains unaltered, whereby the magnetic stamp member-die unit 02,08 can be removable attached to its companion stamp—"mount". However, in this instance the stamp mount 16 now becomes a large magnetically attractive planar surface, a "storage area" 48 for convenient and organized storage, which can hold and keep an abundant number of stamp member-dies units 02,08. (e.g. alphabetically or themed). Stamp members mounted here will be less likely to be lost or misplaced and will most certainly be easier to retrieve. Although the illustrations, for this example indicates a standard "3-ring binder" style sheet of magnetic material, this should by no means be construed as a limitation of form; rather, it should be regarded as a conceptual suggestion of the storage design of this modified stamp-mount 48. In its purest form, said modified mount unit 48 serves as a storage sheet, hence, the current 3-ring representation. Any larger storage unit could take the form of a "3-ring binder", or binder-like, unit, a compound stackable "shadow box" (not shown) or any manner of storage unit. Currently, when stamp users purchase individual stamp member-dies 02 (those stamp member-dies without mounts) they have no special storage location and are placed in plastic bags, or boxes; as such they are subject to be misplaced, or at the very least, to be mixed up, creating hassles and time lost. Utilizing a convenient organizable and retrievable method such as this, which affords easy additions, organization and quick access to numerous stamp images, is definitely a worthwhile and advantageous modification. This alternate stamp-mount 48 does not need to have its magnetic material mounted to a very rigid supporting material for stamping as does the main stamp mount design 16. In fact flexiblility, in some instances, may in fact be preferrable, such as when using a sheet-like storage unit. Included are some alternative material combinations which could form this variant of a flexible stamp storage mount 48. The first is where said stamp storage mount 48 is composed entirely of a sheet of rubber-like magnetic composite material component; it could also be composed of a very thin sheet of magnetic material glued to any flexible material, or even a thin sheet of ferromagnetic material 18 by itself. Again, these are but examples and should be construed as illustrative suggestions.

Custom Cut Magnetic Forms—Description

Referring to FIG. 4 again, illustrated here along with the many 02, 08 stamp member-die units, and fastened onto said stamp storage mount 48, are representations of the third embodiment of this invention, where users can simply cut their own stamp shapes and forms 42 directly out of a rubber-like magnetic stamp coupling material 06. The typical flexible magnetic composite material composing today's magnets, has enough compression ability and holds ink well enough, that it can act as a form of substitute stamp member. In addition, these "substitute stamp form dies" 42, being cut directly out of magnetic material itself 06, will alleviate the need for any fastening vehicle since they will independently attract to their partner stamp mount half 16 (and its appropriate magnetic components). In this way, when used as stamping images, said cut stamping forms 42 allow the user to take advantage of the magnetic attractive component of a magnetic coupling material 06 while being able to create their own fully-customized images serving as dies, 42. Not only will this offer a method whereby users can create and have total ownership of the images on those stamps ( and can foster pride and self-esteem), furthermore, this method has a potential to produce an infinite amount images/shapes for the user; children, individual, or groups, desiring to create their own custom stamps shapes might find this third embodiment of my invention to be very desirable.

Semi-transparent Magnet—Description

Referring to FIGS. 6 through 10 here utilizing magnets with the mount (16) as the primary attraction force of this invention. Recalling the reciprocal nature of magnetic element pairings, either the base or stamp-member portion of the invention (or both portions) can utilize "magnets", per se', to attract its respecitive partner piece in this invention. If a functional "magnets", or magnetic materials are patterned onto or imbedded within a clear mount (whether utilizing a clear oversheet 32 or not) this mount can then operate independently as a functional magnet tool by itself. In effect, it becomes a kind of a semi-transparent magnet. This is an important derivative aspect of this invention, which may find uses in other areas, especially where a fair amount of visibility through a magnetic material would prove advantageous) such as children's games, science activities, scientific or technological derivatives etc.

Regarding the fourth optional embodiment of the magnetic stamp member, in addition to providing transparency benefits with a combined magnetic attractive component as described in FIG. 10 in detail, the semi-translucent magnetic mount unit 54 of this invention, when using permanent magnetic materials imbedded into said mount unit 54, will also effectively function separately like any other typical magnet used today. A semi-transparent magnet will retain the majority of attractive capabilities of a regular magnet while adding the element of partial "see-through" ability. A "semi-transparent magnet" may provide users with hours of fun attracting magnetic elements of any type to this handle just as any magnet will, but the user will also be able to see, in a mostly unobstructed manner, anything they are attracting with said semi-transparent magnet. This heretofore never before seen aspect of magnet usage will surely find its way into children's games and learning activities which use magnets as well as functional uses in any application where magnets are used and where transparency will be advantageous. Not only will it provide a novel interpretive aspect to magnets it will also provide a new way to look at magnetic elements (both literally and conceptually). This, consequently, can "rejuvenate" interest in the sciences and magnets from those who previously have lost interest and can "spark" a whole new generation of eager users of magnets; not to mention just increase the basic "fun" of working with magnets.

Semi-transparent and Opaque "Magnetic Clay"—Description

Referring to FIG. 8 again, which is a representation magnetic elements embedded into a rigid transparent stamp mount material. Concerning the "transparent magnet" specifically, said magnetic materials 56 need not only be imbedded into a solid material, serving as a magnet; said magnetic materials 56 could also be imbedded within flexible transparent material. For example, a viscous or semi-viscous clear liquid material could house magnetic particles. Or in like manner, said particles could be imbedded into any clear, "claylike" or malleable material (not shown). With the former, a clear liquid material would have to be contained within a clear "baglike", envelope; with the latter, the denser material itself should provide enough internal tension to hold its own "guts", so to speak. Whatever the form however, this malleable clear material would have the highly advantageous ability to conform to differing shapes and be worked into existing contours. Clearly, this "see-through magnetic clay" would be very intriguing as a toy or novelty item, but it would also be very useful in situations where the elements of malleability, magnetic attraction and the added benefit of translucency are desired. And as with all description above, those skilled in the arts will know which materials may work best. In addition, as with any transparent magnetic consideration thus far, the above could also be applied to a opaque substances, creating an "opaque magnetic clay", or malleable magnet", respectively. While translucency would be lost, all the benefits of malleability and manipulatability would be maintained. Finally, with the above description of the semi-translucent magnet, this embodiment of the invention may prove to be very useful in many other areas, too, in either the translucent or opaque mediums.

Coupling Unit as Typical Magnetic Fastener—Description

Figure 12:
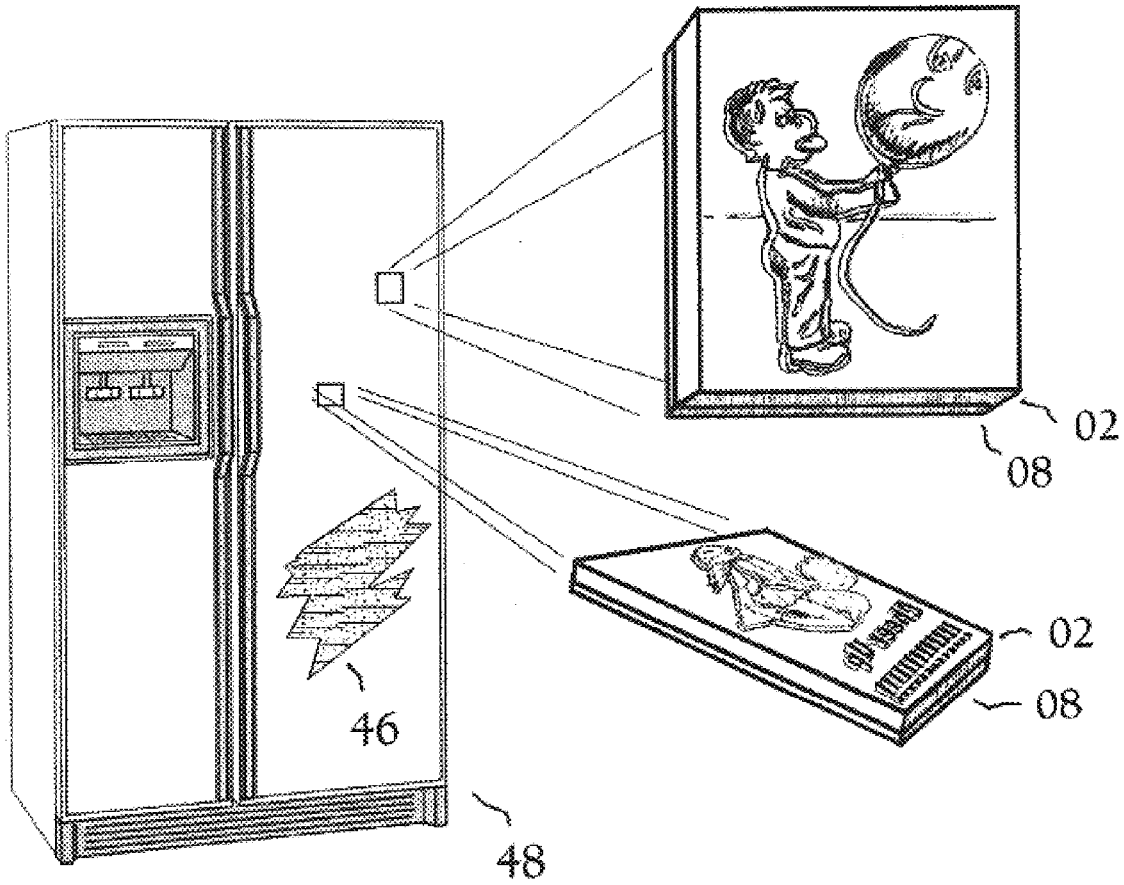
FIG. 12 is a partially exploded view of the optional embodiment of this invention, where the magnetic stamp member-die portion is being attached to a refrigerator or any ferromagnetic surface becoming decorative or utilitarian magnetic fasteners.

Referring to FIG. 12, this is a representation of the sixth optional embodiment of the magnetic stamp member, where said magnetic stamp member-die components 02,08 are being attached to a refrigerator, or any ferromagnetic surface 58. This is pretty self explanatory, however it is worth mentioning that as utilitarian and decorative pieces, these component halves of my invention, 02, 08 coupling units, can be fastened to any ferromagnetic surface and are not just limited to refrigerators; they can be fastened to any magnet or magnet attracting metallic surface 54, such as metal file cabinets and the like. In addition, when functioning as "refrigerator magnets"—for lack of a better description—said magnetic coupling units 02,08, can hold thin materials, such as papers and notepads through the power of permeated magnetic attraction. When these materials are "sandwiched" between said magnetic stamp-die unit 02,08, and the chosen ferromagnetic surface 54, said stamp die unit becomes a fastener itself. This is accomplished by placing said additional materials by hand against the ferromagnetic material of the surface structure, e.g. a refrigerator door; then said magnetic coupling units 02,08 are placed over said additional materials. Functionally, the magnetic components creates a magnetic attraction bond between the ferromagnetic surface and the magnet itself and through the thin material which is "sandwiched" therein between.

Operation of the Invention

As can be seen throughout the prior descriptions, this invention utilizes a two component system of the magnet fastened stamp member-die coupling unit (02,08) and the magnetically attractive connecting base unit; said connecting base unit can be composed of either magnetic or ferromagnetic material a adhesively fastened to base (14, 16) or (22, 16) respectively, or said connecting base alternatively being composed entirely of a material with magnetic particles imbedded therein (54). Furthermore, each stamp component—either being fastened to its own magnetic component or being composed of magnetic materials itself—operating in a magnetic manner, will functionally retain all of the attraction benefits that magnetic pairings will retain. The resulting functionally magnetic-stamp components will have the distinct benefits of easy fastening, repositioning, removability, interchangeability and combinability. When used together as a stamping unit, the components can be manipulated or combined in virtually an unlimited amount of ways, so that the stamp consumer can create an equally broad range of stamping images utilizing pre-existing magnet fastened rubber stamps, where the new stamp images result from the combinations and placements of the positioned components; or in the case where users cut their own forms out of typical magnetic composite materials, they can even create their own custom designs. In addition, each of the above components, acting individually, will also function like any single magnetic material would. For example, every magnetic coupling unit of this invention (02,08) can magnetically adhere to any other magnet or ferromagnetic surface such as a refrigerator or the like. Similarly, every base connecting component by itself, (e.g. the stamp mount, stamp storage unit or semi-transparent magnet variations) can removably hold any magnet. In the case of said semi-transparent magnet variants, this base (54) can also serve in a stand-alone capacity as a magnet itself. Of course, each separate magnetic fastening material must be properly aligned magnetically to its partner component so as to be attractive to each other and not repel.

CONCLUSION, RAMIFICATIONS AND SCOPE OF INVENTION

Thus, the reader will see that the magnetic stamp member holding and positioning device provides a highly enjoyable, easy to use, non-toxic, safe and economical means of creating a combinable, repositionable, interchangeable rubber stamp that can be constructed and used of by groups or persons of almost any age. In addition, this custom stamp creating process allows one to be able to become involved with the stamp creation process by utilizing any pre-existing image or combination of images, or by cutting their own custom stamp forms, thereby increasing the user's sense of pride and ownership of their custom stamps. This rubber stamp fastening invention can find many valuable uses in educational, business and clinical settings. In addition, this invention allows stamp users to become more time efficient where they can combine many stamps for single stamping in an omni-positioning system. Likewise, for clear stamp handle users, this invention's optional use of a semi-transparent magnetic stamp handle affords said stamp user the ability to accurately and flexibly position and combine stamps better than any method existing before. Likewise, regarding larger rubber stamp production and manufacture, this invention can be incorporated quite fluidly into existing rubber stamp manufacture without the need for major change. This will allow interested stamp manufacturers to conveniently convert any portion, or all of their existing line of rubber stamps to a magnetic fastening means, while using substantially the same manufacturing tools and with very little difficulty, effort, expense or time involved. Similarly, any operation, which utilizes rubber stamps during manufacture, could benefit highly, by employing these magnetically adjustable and combinable rubber stamps. Furthermore, component parts of this invention, when taken by themselves, provide the following: (a) a convenient storage unit for easily accessed magnetic stamp member dies, (b) a method for small scale stamp users to quickly and effortlessly convert existing rubber stamp dies to a magnetic means, (c) a method for individuals to create their own custom stamp forms, (d) a functional semi-transparent magnet, (e) a functional semi-transparent and opaque magnetic "clay" and (f) a decorative and/or utilitarian use of the stamp member dies as "refrigerator magnets".

While the above description contains many specifics, these should not be construed as limitations on the scope of the invention, but instead as an examples of the principals of this invention. Many other variations are possible. For example, instead of being limited to a rectangular shape, this invention can be envisioned in many shapes, from triangular to circular, or any useful or desired combination.

Additionally, while the magnetic materials fastened to the stamp member-die elements 02 seem to conform to the exact shapes of their respective stamp coupling components (and this would surely be the case if said magnetic elements were fastened prior to the cutting and if both components were cut together during manufacture), however, need not necessarily be the case. In addition, the strength of the magnetic materials used can be varied as required, or desired. And since magnets, and magnetic materials come in all strengths and forms, this would be a simple matter to accomplish. Also, the color and thickness of any material can be adjusted as necessary or desired.

What is claimed is:

1. A rubber stamp printing device for use in a stamping process, comprising:

a magnetic stamp mount having an upper surface and a substantially rigid and planar lower surface opposite the upper surface, the stamp mount having a magnetic means imbedded therein; the magnetic means comprising distinct vertical magnets imbedded in a vertical direction substantially through the entire thickness of said stamp mount from said upper surface to said lower planar surface; and at least one stamp die having an ink receiving printing surface and a second surface opposite the printing surface, wherein means for holding ink in a pattern corresponding to an ink image are formed on said printing surface, said stamp die being formed of rubber material and including a magnetic material to form a functional stamp-die magnet;

wherein said second surface of said stamp die is releasably secured to said planar lower surface of said stamp mount due to the magnetic attraction of said distinct vertical magnets in said stamp mount to the magnetic material of said stamp die to allow the stamp die to be unmovably fastened onto the mount during stamping but easily manipulated and repositioned by a user at any time prior to, during, or after the stamping process.

2. The rubber stamp printing device of claim 1, wherein said magnetic material of said stamp die is imbedded discrete magnetic particles.

3. The rubber stamp printing device of claim 2, wherein said magnetic particles are comprised of ferromagnetic material.

4. The rubber stamp printing device of claim 1, wherein said magnetic material of said stamp die is an adhesively attached magnetically receptive element.

5. The rubber stamp printing device of claim 1, wherein the magnetic stamp mount is substantially transparent or opaque.

6. The rubber stamp printing device of claim 5, wherein said distinct vertical magnets are elongated both longitudinally and laterally along a horizontal linear plane becoming interwoven vertical magnetic plates thereby further increasing the level of magnetic attraction while in addition providing a built-in overhead viewable grid pattern which aid in positioning of said stamp dies when attached to said substantially transparent stamp mount.

7. The rubber stamp printing device of claim 5, further comprising a supplemental handle, wherein said substantially transparent or opaque stamp mount is fastened to said supplemental handle.

8. The rubber stamp printing device of claim 7, wherein the substantially transparent or opaque stamp mount is fastened to said supplemental handle by an adhesive.

9. The rubber stamp printing device of claim 5, wherein said substantially transparent or opaque stamp mount is in the form of a storage sheet configured to secure a plurality of stamp dies.

10. The rubber stamp printing device of claim 9, wherein said storage sheet includes holes along one side edge of said sheet for engagement with rings of a ring bound folder.

11. The rubber stamp printing device of claim 1, wherein the stamp mount is substantially transparent and functions as a substantially transparent permanent magnet.

12. The rubber stamp printing device of claim 11, wherein said stamp mount consists of a block of clear acrylic.

* * * * *